US008137072B2

(12) United States Patent
Kim et al.

(10) Patent No.: US 8,137,072 B2
(45) Date of Patent: Mar. 20, 2012

(54) TURBINE BLADE INCLUDING A SEAL POCKET

(75) Inventors: Hyun Dong Kim, San Diego, CA (US); Marius Dumitrascu, San Diego, CA (US); Michael Eugene Greenspan, San Diego, CA (US); Yungmo Kang, San Diego, CA (US); Yong Weon Kim, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 810 days.

(21) Appl. No.: 12/289,693

(22) Filed: Oct. 31, 2008

(65) Prior Publication Data

US 2010/0111700 A1 May 6, 2010

(51) Int. Cl.

| | |
|---|---|
| ***F01D 5/30*** | (2006.01) |
| ***F01D 11/00*** | (2006.01) |
| ***B21K 25/00*** | (2006.01) |

(52) U.S. Cl. ..... 416/193 A; 416/190; 416/192; 416/193 R; 416/248; 416/500

(58) Field of Classification Search ..... 416/193 A, 416/500, 248, 190, 192, 193 R; 29/889.21
See application file for complete search history.

(56) References Cited

U.S. PATENT DOCUMENTS

| | | | |
|---|---|---|---|
| 2,912,223 | A | 11/1959 | Hull, Jr. |
| 3,112,915 | A | 12/1963 | Morris |
| 3,610,778 | A | 10/1971 | Suter |
| 3,666,376 | A | 5/1972 | Damlis |
| 3,751,183 | A | 8/1973 | Nichols et al. |
| 3,918,842 | A | 11/1975 | Longley et al. |
| 4,872,812 | A | 10/1989 | Hendley et al. |
| 4,936,749 | A | 6/1990 | Arrao et al. |
| 5,161,949 | A | 11/1992 | Brioude et al. |
| 5,201,849 | A | 4/1993 | Chambers et al. |
| 5,228,835 | A | 7/1993 | Chlus |
| 5,339,619 | A | 8/1994 | Antonellis |
| 5,415,526 | A | 5/1995 | Mercadante et al. |
| 5,478,207 | A | 12/1995 | Stec |
| 5,513,955 | A | 5/1996 | Barcza |
| 6,273,683 | B1 | 8/2001 | Zagar et al. |
| 6,354,803 | B1 | 3/2002 | Grover et al. |
| 6,450,769 | B2 | 9/2002 | Szwedowicz |
| 6,478,544 | B2 | 11/2002 | Brandl et al. |
| 6,851,932 | B2 | 2/2005 | Lagrange et al. |
| 6,932,575 | B2 | 8/2005 | Surace et al. |
| 7,090,466 | B2 | 8/2006 | Honkomp et al. |
| 7,097,429 | B2 | 8/2006 | Athans et al. |

(Continued)

FOREIGN PATENT DOCUMENTS

| | | |
|---|---|---|
| JP | 10252413 | 9/1998 |

(Continued)

*Primary Examiner* — Michelle Estrada
(74) *Attorney, Agent, or Firm* — Finnegan, Henderson, Farabow, Garrett & Dunner LLP

(57) ABSTRACT

A turbine blade is disclosed. The turbine blade may have an airfoil extending from a first surface of a turbine platform. The turbine blade may further have a first side pocket of the turbine platform that is configured to substantially entirely house a first moveable seal between a forward wall of the first side pocket and an aft wall of the first side pocket. The first side pocket may have a convex surface, extending between the forward wall and the aft wall, and a concave surface. The turbine blade may also have a second side pocket of the turbine platform configured to receive a portion of a second moveable seal.

23 Claims, 6 Drawing Sheets

U.S. PATENT DOCUMENTS

| | | | | |
|---|---|---|---|---|
| 7,104,758 | B2 | 9/2006 | Brock et al. | |
| 7,121,802 | B2 | 10/2006 | Athans et al. | |
| 7,322,797 | B2 | 1/2008 | Lee et al. | |
| 7,367,123 | B2 | 5/2008 | Itzel et al. | |
| 2004/0028529 | A1* | 2/2004 | Austin et al. | 416/248 |
| 2006/0056975 | A1 | 3/2006 | Honkomp et al. | |
| 2008/0025842 | A1* | 1/2008 | Marini et al. | 416/193 A |

FOREIGN PATENT DOCUMENTS

| | | |
|---|---|---|
| KR | 1020050083579 | 8/2005 |
| KR | 1020060089649 | 8/2006 |

* cited by examiner

TURBINE BLADE INCLUDING A SEAL POCKET

TECHNICAL FIELD

The present disclosure relates generally to a turbine blade and, more particularly, to a turbine blade including a pocket for receiving a moveable seal.

BACKGROUND

Gas turbine engines ("GTE") are known to include one or more stages of turbine rotors mounted on a drive shaft. Each turbine rotor includes a plurality of turbine blades extending circumferentially around the turbine rotor. The GTE ignites a mixture of air/fuel to create a flow of high-temperature compressed gas over the turbine blades, which causes the turbine blades to rotate the turbine rotor. Rotational energy from each turbine rotor is transferred to the drive shaft to power a load, for example, a generator, a compressor, or a pump.

A turbine blade typically includes a root structure and an airfoil. It is known for the airfoil and the root structure to extend from opposite sides of a turbine blade platform. The turbine rotor is known to include a slot for receiving each turbine blade. The shape of each slot may be similar in shape to the root structure of each corresponding turbine blade. When a plurality of turbine blades are assembled on the turbine rotor, a gap may be formed between and/or beneath turbine platforms of adjacent turbine blades. An ingress of high-temperature compressed gas between the gaps of adjacent turbine blade platforms may cause fatigue or failure of the turbine blades due to excessive heat and/or vibration.

Various systems for regulating the flow of compressed gas around turbine blades are known. For example, it is known to use a moveable element to bridge the gap between adjacent turbine blades. When the turbine rotor is not rotating, the position of the moveable element is dictated by the force of gravity. However, when the turbine rotor is rotating, the moveable element may be forced radially outward by centrifugal force to bridge a gap between adjacent blades. While moveable elements can regulate the flow of compressed gas, current systems may be difficult to assemble and/or require an excessive amount of space.

One example of a system including a moveable pin between rotor blades is described in U.S. Pat. No. 7,104,758 to Brock et al. ("the '758 patent"). The '758 patent discloses a rotor including a plurality of rotor blades. Each rotor blade includes a blade foot, a blade leaf, and a cover plate. A gap is defined between each cover plate when the rotor blades are assembled on the rotor. Pockets are formed on two sides of each cover plate such that adjacent rotor blades form a cavity of two opposing pockets to house a moveable pin. The '758 patent discloses that the cavity spans the gap between adjacent cover plates and may be tear-drop shaped. When the turbine is rotating, the pin will move radially outward due to centrifugal force and wedge between walls of two opposing pockets to bridge the gap and reduce vibrations.

Although the system of the '758 patent may disclose using a pin for filling a gap between cover plates of adjacent turbine blades, certain disadvantages persist. For example, the construction of the cavity in the '758 patent with the disclosed tear-drop shape may inefficiently remove more material than is necessary to house and guide the moveable pin. The inefficient removal of material to form the tear-drop-shaped cavity may adversely impact the design of the cover plate, weakening the structural integrity of the cover plate and/or requiring increased thickness of the cover plate to accommodate the removal of material.

SUMMARY

In one aspect, the present disclosure is directed to a turbine blade. The turbine blade may include an airfoil extending from a first surface of a turbine platform. The turbine blade may further include a first side pocket of the turbine platform that is configured to substantially entirely house a first moveable seal between a forward wall of the first side pocket and an aft wall of the first side pocket. The first side pocket may include a convex surface, extending between the forward wall and the aft wall, and a concave surface. The turbine blade may also include a second side pocket of the turbine platform configured to receive a portion of a second moveable seal.

In another aspect, the present disclosure is directed to a method of assembling a turbine rotor assembly. The method may include the step of mounting a first turbine blade to a turbine rotor. The method further includes the step of positioning a moveable seal substantially entirely within a side pocket of the first turbine blade. After mounting the first turbine blade to the turbine rotor and after positioning the moveable seal substantially entirely within the side pocket, the method may also include the step of slidably mounting a second turbine blade to the turbine rotor in a direction substantially parallel to the rotational axis of the turbine rotor past the moveable seal.

DETAILED DESCRIPTION

Figure 1:
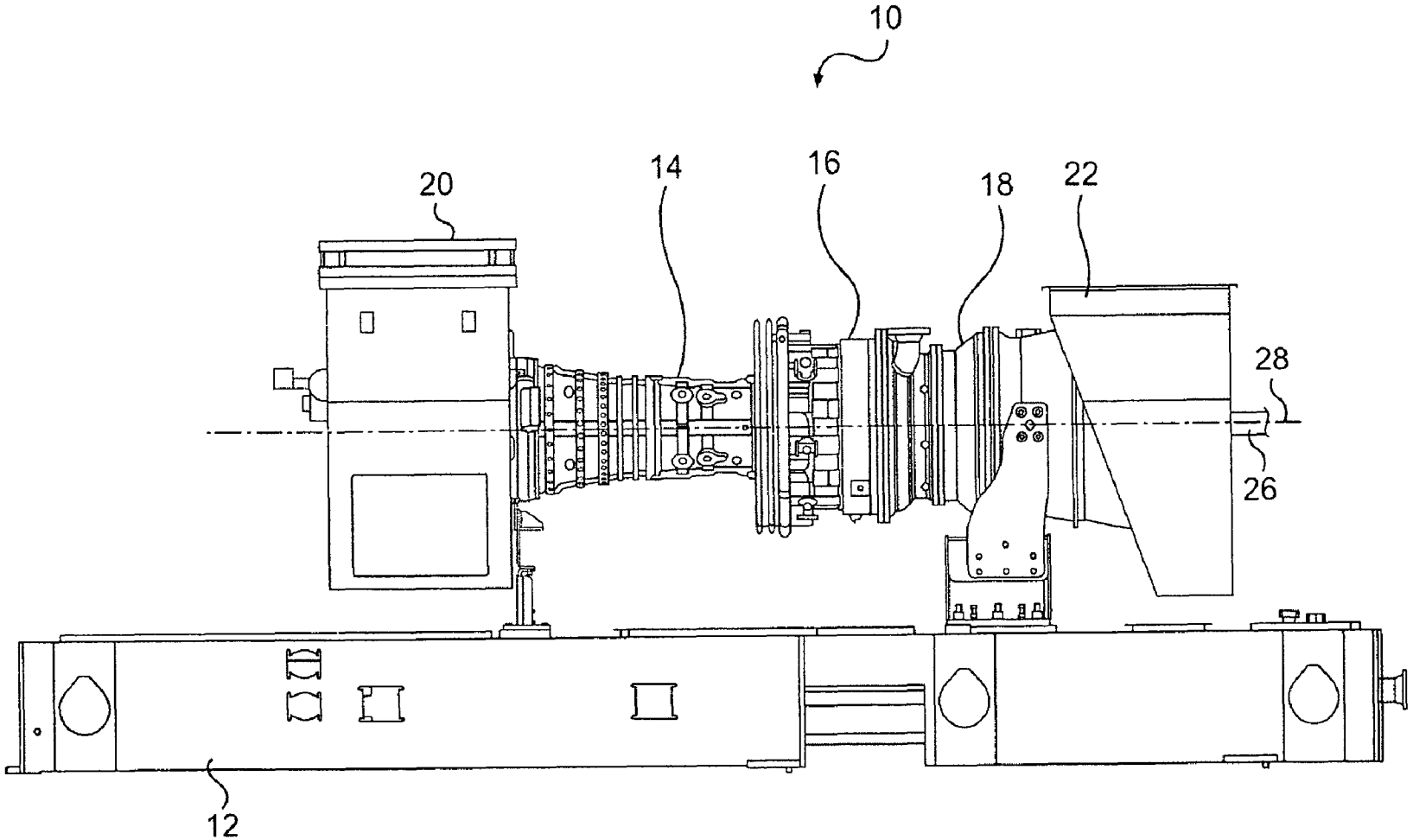
FIG. 1 is a diagrammatic illustration of a GTE mounted on a stationary support structure, in accordance with the present disclosure.

FIG. 1 illustrates a GTE 10 mounted on a stationary support structure 12. GTE 10 may have a plurality of sections, including, for example, a compressor section 14, a combustor section 16, and a turbine section 18. GTE 10 may also include an air inlet duct 20 attached to compressor section 14 and an exhaust collector box 22 attached to turbine section 18.

Figure 2:
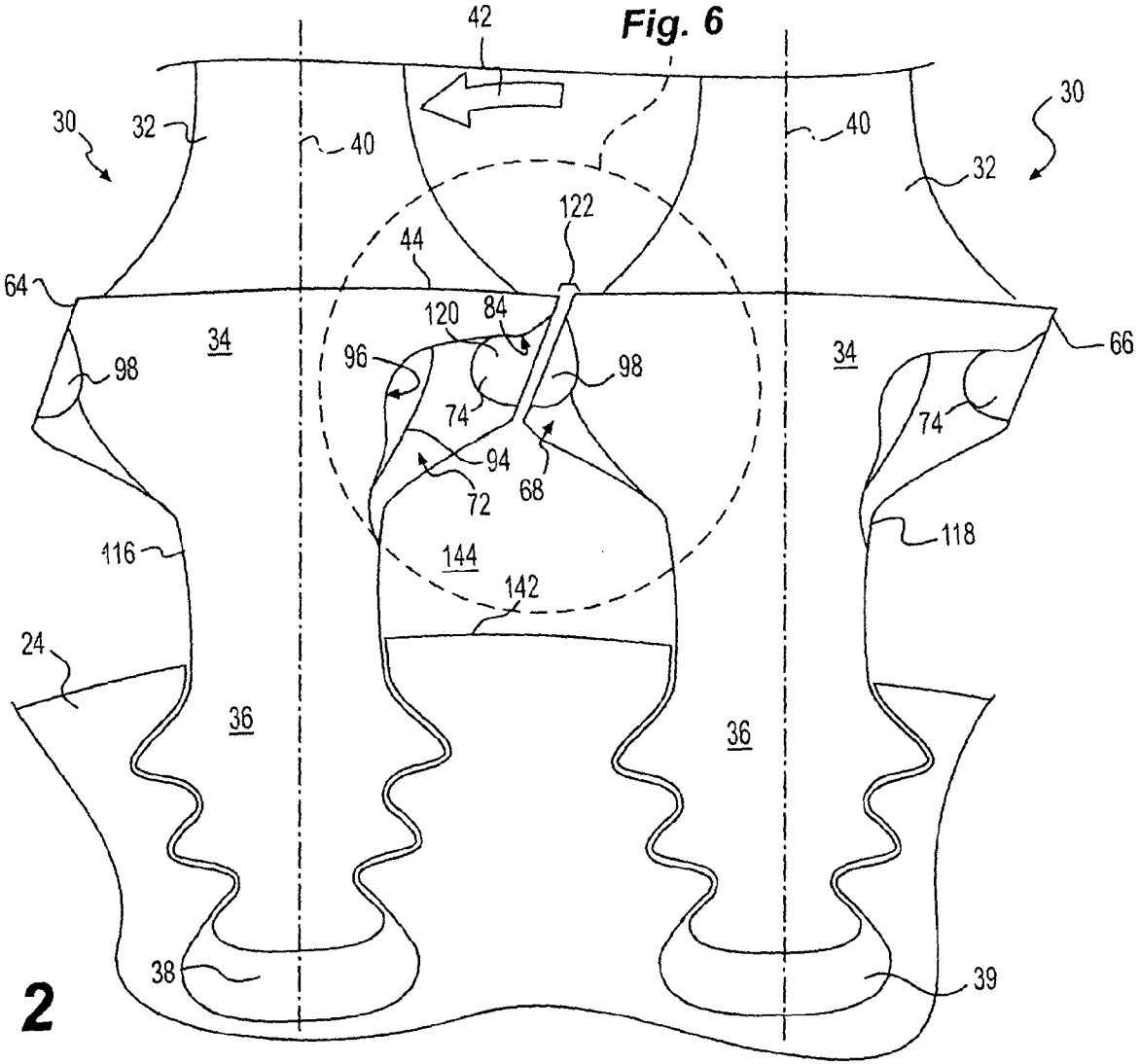
FIG. 2 is a partial cross-sectional illustration of an exemplary turbine rotor of the GTE of FIG. 1.

During operation of GTE 10, compressor section 14 may draw air into GTE 10 through air inlet duct 20 and compress the air before it enters combustor section 16. The compressed air from compressor section 14 may mix with fuel and the air/fuel mixture may be ignited in combustor section 16. High-pressure combustion gases generated by combustor section 16 may be sent through turbine section 18 to rotate one or more turbine rotors 24 (one of which is shown in FIG. 2) attached to a drive shaft 26 to provide rotary power. After passing through turbine section 18, the high-pressure combustion gases generated by combustor section 16 may be directed into exhaust collector box 22 before being expelled into the atmosphere. Air inlet duct 20, compressor section 14, combustor section 16, turbine section 18, and exhaust collector box 22 may be aligned along a longitudinal axis 28 of GTE 10.

Turbine rotor 24 may rotate drive shaft 26, which may transfer rotational power to a load (not shown), for example, a generator, a compressor, or a pump. A plurality of turbine rotors 24 may be axially aligned on drive shaft 26 along longitudinal axis 28 to form a plurality of turbine stages. For example, turbine section 18 may include four turbine stages. Each turbine rotor 24 may be mounted on a common drive shaft 26, or each turbine rotor 24 may be mounted on separate coaxial drive shafts.

As shown in FIG. 2, turbine rotor 24 may be part of a turbine rotor assembly, including, among other components, a plurality of turbine blades 30. Each turbine blade 30 may include an airfoil 32 extending from a turbine platform 34. Further, each turbine blade 30 may also include a root structure 36 extending from turbine platform 34. Root structure 36 may have a shape including a series of projections spaced from each other in the radial direction for receipt in a similarly shaped slot of turbine rotor 24. As shown in FIG. 2, root structure 36 may have a fir-tree-type shape. Turbine rotor 24 may include a plurality of slots for receiving turbine blades 30, including, for example, a first slot 38 and a second slot 39. Each of first and second slots 38, 39 may slidably receive a corresponding root structure 36 of a turbine blade 30. First and second slots 38, 39 may be located along a circumferential outer edge 142 of turbine rotor 24 for receiving each turbine blade 30. Each turbine blade 30 may extend from turbine rotor 24 along a corresponding radial axis 40 from longitudinal axis 28.

It is contemplated that each slot (e.g., first and second slots 38, 39) of turbine rotor 24 may include a broach angle. That is, as each slot extends across circumferential outer edge 142 from a forward face of turbine rotor 24 to an aft face of turbine rotor 24, each slot may be angled in a circumferential direction. For example, the broach angle of each of the slots of turbine rotor 24 may be angled along a circumferential direction by an angle of between zero degrees and 25 degrees. In other words, a zero degree broach angle of first slot 38 may align relative to a line parallel to longitudinal axis 28, and a broach angle (e.g., 20 degrees) other than zero degrees may be angled relative to a line parallel to longitudinal axis 28 by the broach angle. In an exemplary embodiment, first slot 38 may include a 12 degree broach angle. It is contemplated that each turbine blade 30 may include a matching broach angle relative to its corresponding slot within turbine rotor 24. That is, root structure 36 of turbine blade 30 may be angled with respect to a front face 37 of root structure 36 (see FIG. 3) to coordinate with the broach angle of its corresponding slot (e.g., first slot 38) of turbine rotor 24. Therefore, each turbine blade 30 may slide into its corresponding slot (e.g., first slot 38) of turbine rotor 24 in a direction substantially parallel to longitudinal axis 28, but angled from a forward face of turbine rotor 24 to an aft face of turbine rotor 24 in a circumferential directional by a broach angle (e.g., 0 to 25 degrees). While only two turbine blades 30 and two corresponding slots 38, 39 are shown in FIG. 2, any number of turbine blades 30 sufficient to provide power to the load may be implemented.

Figure 3:
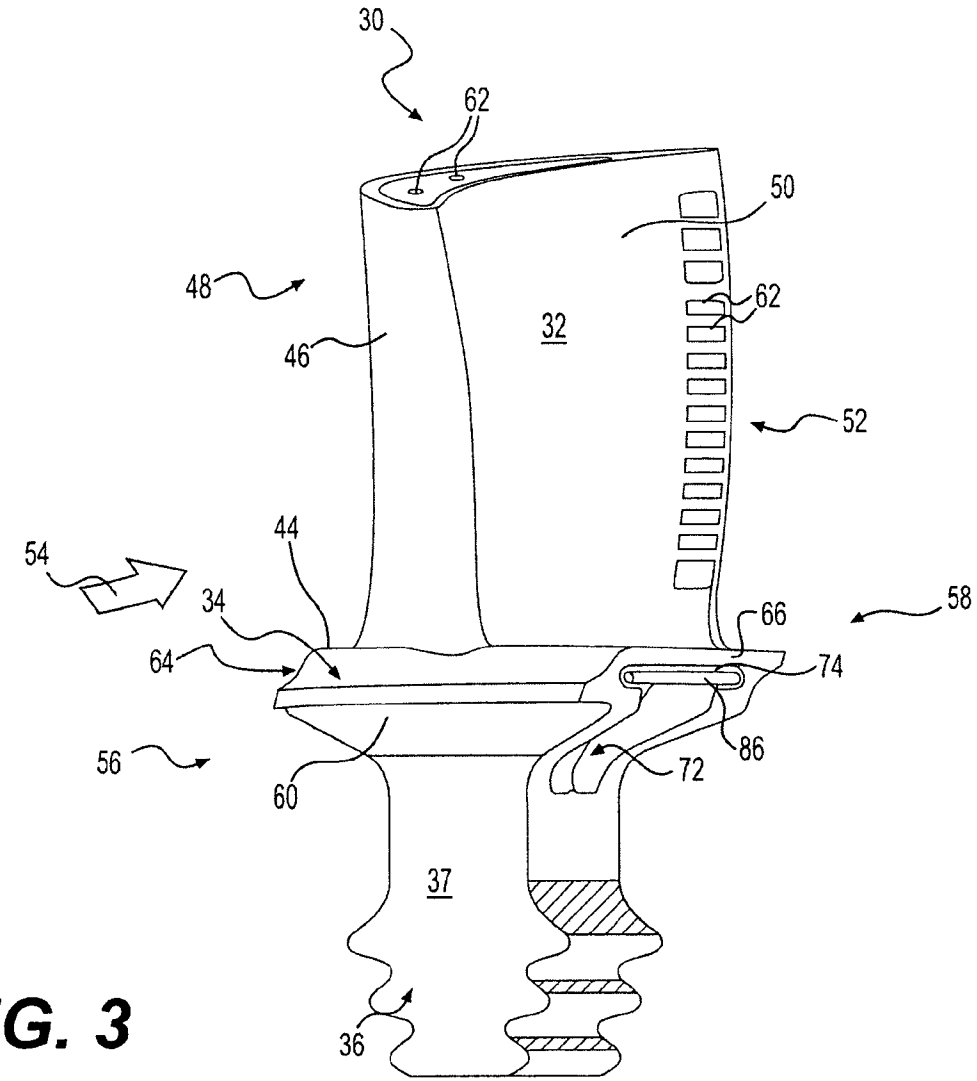
FIG. 3 is a diagrammatic illustration of an exemplary turbine blade.

As shown in FIG. 3, airfoil 32 of turbine blade 30 may extend out from an upper surface 44 of turbine platform 34. Airfoil 32 may include a suction side face 46 with a substantially convex surface geometry on a suction side 48 of turbine blade 30. Further, airfoil 32 may include a pressure side face 50 with a substantially concave surface geometry on a pressure side 52 of turbine blade 30. The high-pressure gases may flow in a direction indicated by arrow 54 and may impinge a forward end 56 of turbine blade 30. Turbine blade 30 may include an aft end 58 opposite forward end 56. That is, the flow of high-pressure gases may first pass forward end 56 and then pass aft end 58 of turbine blade 30. When turbine blade 30 is impinged with the flow of high-pressure gases, the aerodynamic shape of airfoil 32, formed by suction side face 46 and pressure side face 50, may cause turbine rotor 24 to rotate in a direction indicated by arrow 42 (shown in FIG. 2).

Root structure 36 may extend down from a lower surface 60 of turbine platform 34. While an exemplary embodiment of root structure 36 of FIG. 3 shows three rounded, fir-tree-shaped limbs on each of suction side 48 and pressure side 52, any geometry sufficient to secure root structure 36 within a corresponding slot 38, 39 of turbine rotor 24 may be implemented. It is contemplated that an aft rim seal (not shown) may be mounted on an aft side of turbine rotor 24 to cover a portion of slots 38, 39 to limit axial movement of each turbine blade 30. Similarly, a forward rim seal (not shown) may be mounted on a forward side of turbine rotor 24 to cover a portion of slots 38, 39 to limit axial movement of each turbine blade 30. The forward and aft rim seals may be fastened to turbine rotor 24 by any fastener sufficient to limit axial movement of turbine blades 30, including, for example, one or more bolts (not shown).

Turbine blade 30 may include a plurality of outlet flow passages 62 for expelling cooling air from turbine blade 30. In addition to outlet flow passages 62, turbine blade 30 may also include one or more inlet flow passages (not shown), for example, in the tip of root structure 36 for receiving cooling air into turbine blade 30. The inlet flow passages may connect to outlet flow passages 62 via interior flow paths (not shown) for cooling turbine blade 30.

Turbine platform 34 may include a suction side slash face 64 on suction side 48 and a pressure side slash face 66 on pressure side 52. Suction side slash face 64 and pressure side slash face 66 may be angled relative to radial axis 40. Further, suction side slash face 64 may include a suction side cavity 68 (best shown in FIG. 5) extending into turbine platform 34 and an upper portion 70 of root structure 36. Similarly, pressure side slash face 66 may include a pressure side cavity 72 (best shown in FIG. 4) extending into turbine platform 34 and upper portion 70 of root structure 36. Suction side cavity 68 and pressure side cavity 72 may be formed in turbine blade 30 to reduce the mass of turbine blade 30.

Figure 4:
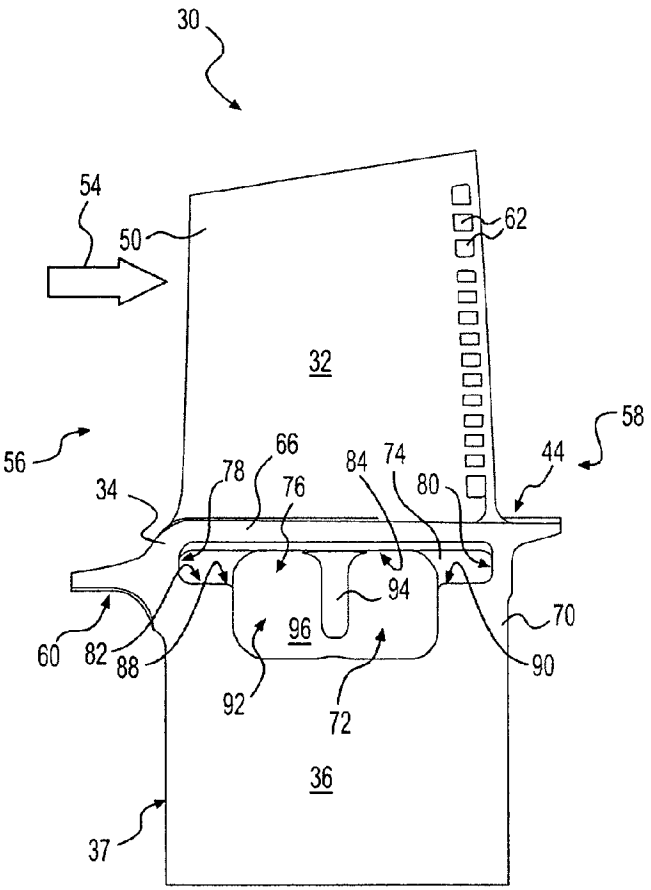
FIG. 4 is a side view of a pressure side of the exemplary turbine blade of FIG. 3.

As shown in FIG. 4, pressure side slash face 66 may include a pressure side pocket 74 extending across an upper portion 76 of pressure side cavity 72. Pressure side pocket 74 may include a longitudinal opening within pressure side slash face 66 defined by a forward wall 78, an aft wall 80, a lower surface 82, and an upper surface 84 for receiving a moveable element, for example, a moveable seal. It is contemplated that the moveable seal may be a pin seal 86 (shown in FIG. 3). Forward wall 78 and aft wall 80 of pressure side pocket 74 may be rounded in order to limit binding movement with the ends of pin seal 86 within pressure side pocket 74. Lower surface 82 of pressure side pocket 74 may include a forward shelf 88 adjacent forward wall 78 and an aft shelf 90 adjacent aft wall 80, such that lower surface 82 of pressure side pocket 74 may be discontinuous and include a gap between forward shelf 88 and aft shelf 90, which opens into a lower portion 92 of pressure side cavity 72. As best shown in FIG. 4, pressure side pocket 74 may be wider (i.e., in an axial direction) than pressure side cavity 72. As best shown in FIG. 2, pressure side cavity 72 may extend deeper inward of pressure side slash face 66 of turbine platform 34 than pressure side pocket 74. Since the depth of pressure side cavity 72 may define a substantial overhang for turbine platform 34 on pressure side 52, pressure side cavity 72 may include a pressure side cavity support 94 located on an inner wall 96 of pressure side cavity 72. Pressure side cavity support 94 may be elongated and taper out from inner wall 96 of pressure side cavity 72 toward upper surface 84 of pressure side pocket 74 to help support the overhanging portion of turbine platform 34 (best shown in FIG. 6).

Figure 5:
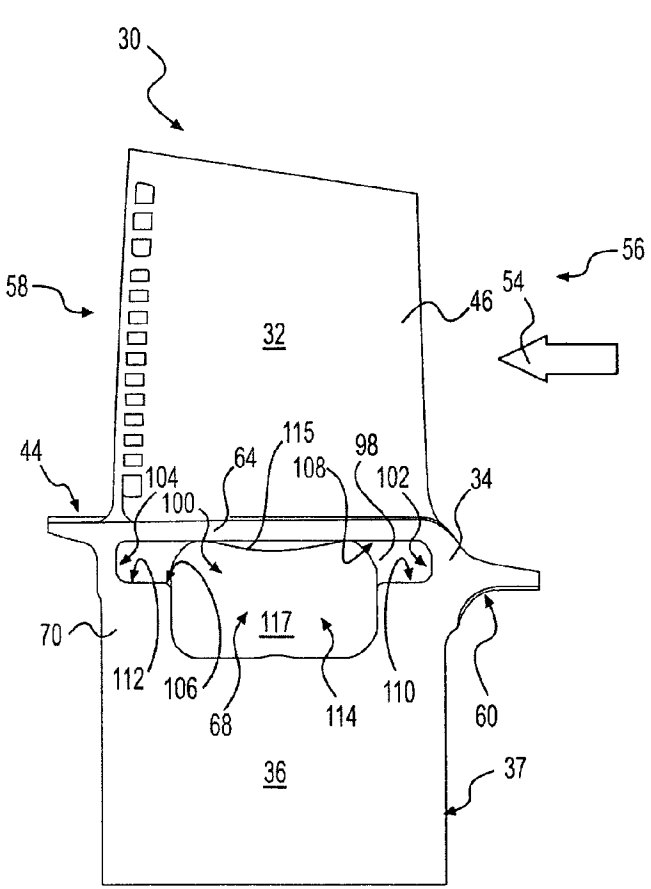
FIG. 5 is a side view of a suction side of the exemplary turbine blade of FIG. 3.

As shown in FIG. 5, suction side slash face 64 may include a suction side pocket 98 extending across an upper portion 100 of suction side cavity 68. Suction side pocket 98 may include an opening within turbine platform 34 defined by a forward wall 102, an aft wall 104, a lower surface 106, and an upper surface 108 for at least partially receiving pin seal 86. Forward wall 102 and aft wall 104 of suction side pocket 98 may be rounded in order to limit binding movement of the ends of pin seal 86 within suction side pocket 98. Similar to lower surface 82 of pressure side pocket 74, lower surface 106 of suction side pocket 98 may include a forward shelf 110 adjacent forward wall 102 and an aft shelf 112 adjacent aft wall 104, such that lower surface 106 of suction side pocket 98 may be discontinuous and include a gap between forward shelf 110 and aft shelf 112, which opens into a lower portion 114 of suction side cavity 68. In contrast to pressure side cavity 72, suction side cavity 68 may not be sufficiently recessed into turbine blade 30 to define a long overhang for turbine platform 34 on suction side 48. Therefore, suction side cavity 68 may include a suction side cavity support 115 extending from an inner wall 117 of suction side cavity 68 that may not be as long as pressure side cavity support 94.

Figure 6:
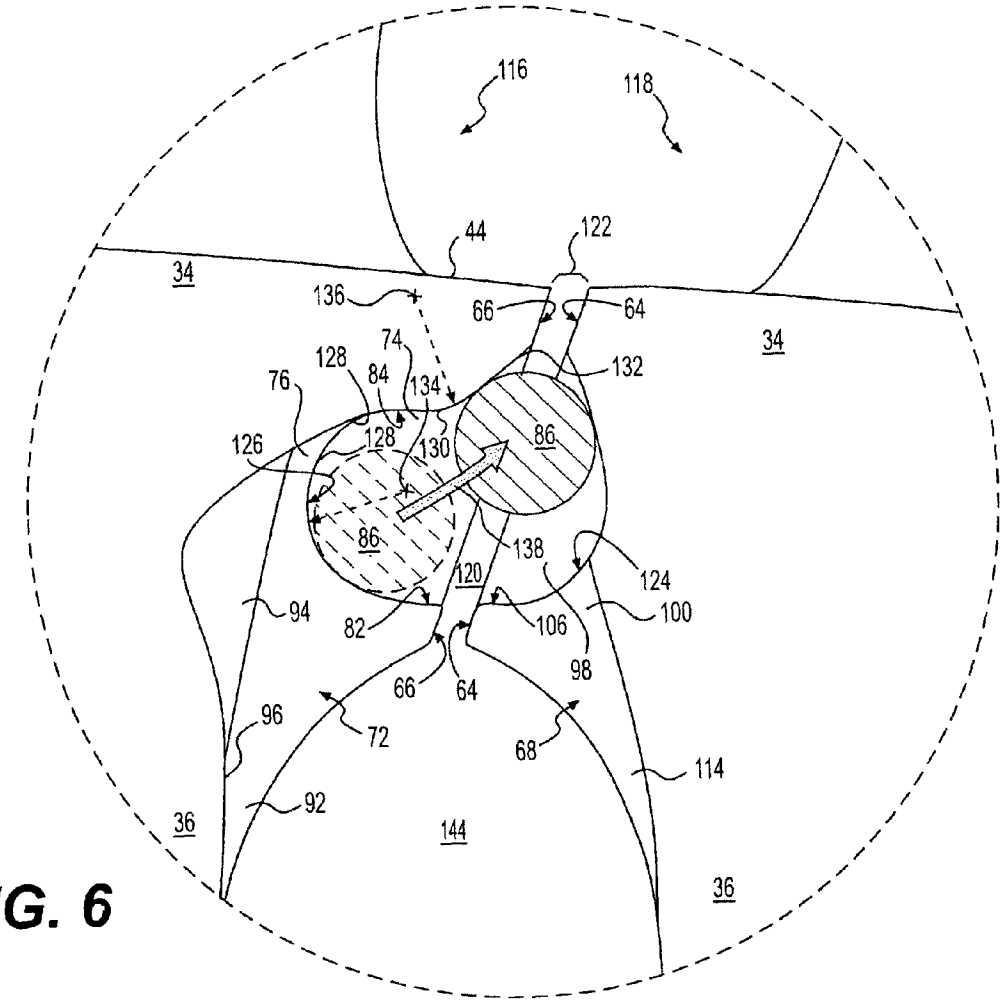
FIG. 6 is an enlarged cross-sectional illustration of the portion of FIG. 2 shown in circle 6.

As shown in FIG. 2 and in closer detail in FIG. 6, a first turbine blade 116 may be positioned on turbine rotor 24 adjacent a second turbine blade 118. While each of first turbine blade 116 and second turbine blade 118 may include a pressure side pocket 74 and a suction side pocket 98, the following discussion will reference the relationship between pressure side pocket 74 of first turbine blade 116 and suction side pocket 98 of second turbine blade 118. When assembled on turbine rotor 24, pressure side pocket 74 may face an opposing suction side pocket 98 to define a seal chamber 120. Further, suction side slash face 64 may be separated from an opposing pressure side slash face 66 by a gap 122.

As best shown in FIG. 6, pressure side pocket 74 may include a geometry that is different from a geometry of suction side pocket 98. More specifically, pressure side pocket 74 may include a cross-sectional geometry that is different from a cross-sectional geometry of suction side pocket 98. For example, suction side pocket 98 may include an interior surface 124 that is concave in cross-section. In some embodiments, interior surface 124 of suction side pocket 98 may be entirely concave in cross-section. In contrast to suction side pocket 98, pressure side pocket 74 may include an interior surface 126 having a more complex cross-section including a concave surface 128, a convex surface 130, and a planar surface 132. Further, pressure side pocket 74 may also be recessed deeper into turbine platform 34 than suction side pocket 98. Pressure side pocket 74 may, for example, extend far enough into turbine platform 34 to allow pin seal 86 to be housed substantially entirely within pressure side pocket 74. In other words, pin seal 86 may include a maximum outside diameter that is less than the distance between the deepest portion of pressure side pocket 74 of first turbine blade 116 and a plane extending along suction side slash face 64 of second turbine blade 118. That is, pin seal 86 may extend slightly past pressure side slash face 66 of first turbine blade 116 when housed substantially entirely within pressure side pocket 74, for example, under the force of gravity. Further, a pin seal 86 housed within pressure side pocket 74 that does not extend beyond pressure side slash face 66 may also constitute a pin seal that is housed substantially entirely within pressure side pocket 74, even though pin seal 86 may be housed entirely within pressure side pocket 74. Even when pin seal 86 extends beyond pressure side slash face 66 of first turbine blade 116, pin seal 86 may not extend far enough beyond pressure side slash face 66 of first turbine blade 116 to interfere with the assembly of second turbine blade 118. Thus, in such circumstances, pin seal 86 may be sufficiently recessed within pressure side pocket 74 to provide clearance for sliding second turbine blade 118 in second slot 39.

It is also contemplated that pin seal 86 may be housed entirely within pressure side pocket 74 (as shown by dashed lines in FIG. 6). That is, the maximum outside diameter of pin seal 86 may be less than the distance between the deepest portion of pressure side pocket 74 and a plane extending along pressure side slash face 66. While only a single pin seal 86 is illustrated for turbine rotor 24 (as shown in FIGS. 2 and 6), it is contemplated that a pin seal 86 may be positioned between each of opposing turbine blades 30 of a turbine stage. For example, a first turbine stage including eighty-eight turbine blades 30 may include eighty-eight pin seals 86.

In order to provide sufficient depth of pressure side pocket 74 for permitting passage of second turbine blade 118 past pin seal 86 during assembly, a cross-section of pressure side pocket 74 may include a concave surface 128, a convex surface 130, and a planar surface 132. Pressure side pocket 74 may include this complex geometry in order to permit pin seal 86 to be housed within pressure side pocket 74, while maintaining a compact design and sufficient structural integrity of turbine platform 34. It is contemplated that the cross-section of pressure side pocket 74 including convex surface 130 (as best shown in FIG. 6) may increase the amount of material between upper surface 44 of turbine platform 34 and upper surface 84 of pressure side pocket 74 when compared to a concave only cross-sectional design for a pressure side pocket. That is, in a concave only design for a pressure side pocket, an excessive amount of material in close proximity to an upper surface of a turbine platform may be removed to form the pressure side pocket, which may unduly weaken turbine platform 34. In order to avoid weakening the turbine blade platform, such a concave only design for the pressure side pocket may be lowered relative to the upper surface of the turbine platform, thereby increasing the thickness of the turbine platform, to provide sufficient structural integrity for turbine platform 34. However, increasing the thickness of the turbine platform may not be desirable. In contrast, the complex cross-section geometry of pressure side pocket 74 including convex surface 130 and planar surface 132 to guide pin seal 86 may provide sufficient material between upper surface 44 and pressure side pocket 74 to sufficiently support turbine platform 34 while maintaining a relatively thin (i.e., in a radial direction) turbine platform 34.

Convex surface 130 and planar surface 132 within pressure side pocket 74 may extend in an axial direction from forward wall 78 of pressure side pocket 74 to aft wall 80 of pressure side pocket 74. Convex surface 130 may serve as a transition between concave surface 128 and planar surface 132. In contrast to convex surface 130 and planar surface 132, concave surface 128 may discontinuously extend between forward wall 78 of pressure side pocket 74 and aft wall 80 of pressure side pocket 74. That is, concave surface 128 may be defined by two concave surfaces spaced from each other by pressure side cavity 72.

Concave surface 128 may include a center of radius 134 located within pressure side pocket 74, and convex surface 130 may include a center of radius 136 located outside pressure side pocket 74. It is contemplated that the radius of concave surface 128 may be similar to the radius of convex surface 130. In an exemplary embodiment, the radius of concave surface 128 may be about 0.055 inches and the radius of convex surface 130 may be about 0.050 inches. However, since the dimensions of turbine blade 30 may vary (e.g., different turbine stages may have different size turbine blades 30), the radius of concave surface 128 and the radius of convex surface 130 may be any length sufficient to support turbine platform 34, house pin seal 86, and guide pin seal 86 to seal gap 122. Planar surface 132 within pressure side pocket 74 may extend radially outward from convex surface 130 toward gap 122 to further guide pin seal 86 in a direction of arrow 138.

Pin seal 86 may be substantially circular in cross-section and extend longitudinally within pressure side pocket 74. In an exemplary embodiment, pin seal 86 may have a maximum diameter of about 0.093 inches. However, since the dimensions of turbine blade 30 may vary, pin seal 86 may have any diameter sufficient to permit passage of an adjacent turbine blade 30 during assembly and regulate the ingress of high-pressure gases through gap 122. Pin seal 86 may be rounded at each of the two ends (best shown in FIG. 7), for example, to reduce binding with forward walls 78, 102 and aft walls 80, 104 during transitional movement from a first position (shown with dashed lines in FIG. 6) to a second position (shown with solid lines in FIG. 6).

It is contemplated that the geometry of pressure side pocket 74 and suction side pocket 98 may be reversed, such that suction side pocket 98 may include the complex geometry previously described with reference to pressure side pocket 74 and pressure side pocket 74 may include the less complex geometry previously described with reference to suction side pocket 98. In other words, suction side pocket 98 may include a geometry incorporating concave surface 128, convex surface 130, and planar surface 132, while pressure side pocket 74 may include a geometry incorporating interior surface 124. Hence, in the reversed pocket geometry configuration, pin seal 86 may be housed substantially entirely within suction side pocket 98, for example, during assembly of the turbine rotor assembly.

Turbine blade 30 may be fabricated by a casting process. More specifically, pressure side pocket 74 and suction side pocket 98 may be fabricated by a casting process in order to form their specific geometric shapes. However, it is contemplated that any fabrication process sufficient to form the geometric shapes of turbine blade 30 may be implemented. For example, a machining process, which may achieve finer tolerances, may be used in lieu of casting or may be used in conjunction with casting. As will be explained below, the use of a damper 140 may create a positive-pressure zone below turbine platforms 34 of adjacent turbine blades 30 which may assist pin seal 86 to regulate the flow of high-pressure gases through gap 122. With the assistance of damper 140 to help regulate the flow of high-pressure gases through gap 122, the tolerances required for sufficient performance of pin seal 86 may be reduced, thereby enabling use of more economical fabrication processes (e.g., casting).

Figure 7:
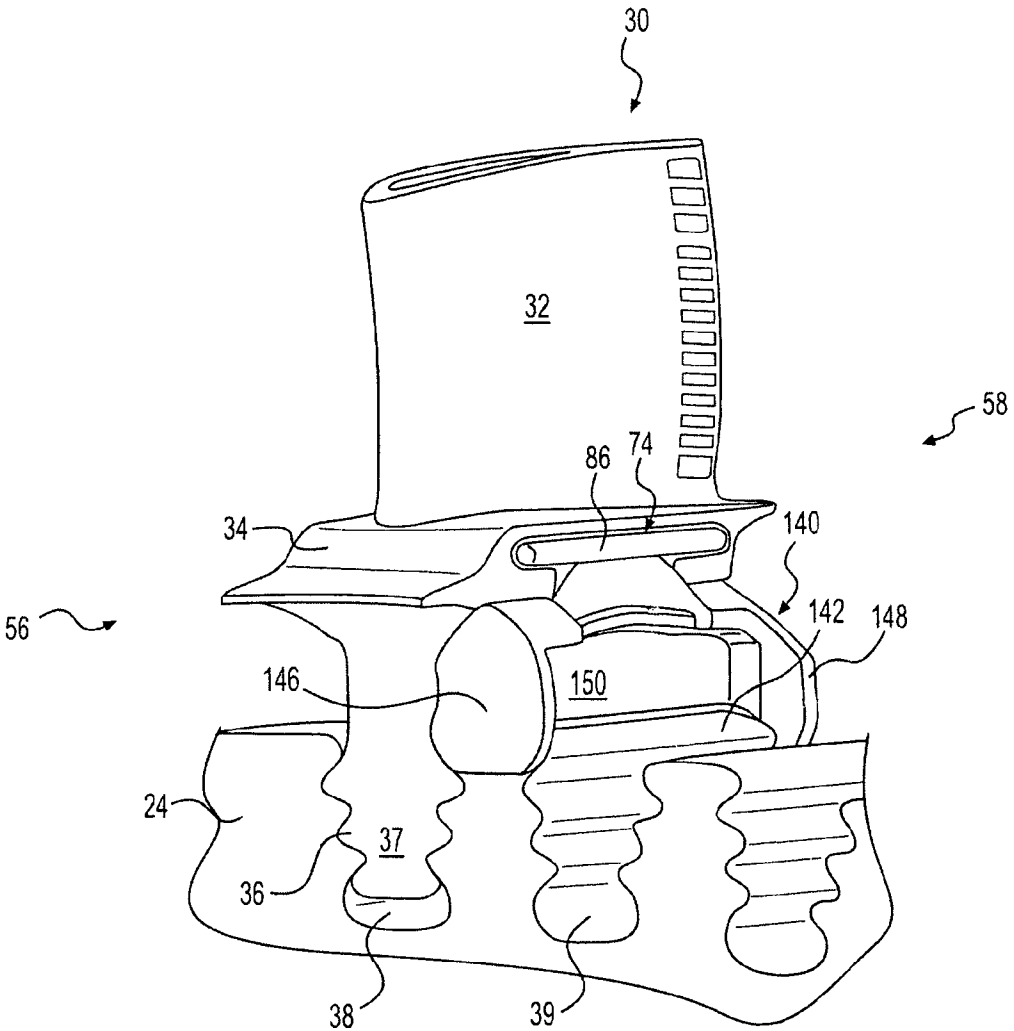
FIG. 7 is a diagrammatic illustration of the exemplary turbine blade of FIG. 3 mounted to a turbine rotor with a damper disposed adjacent the turbine blade.

As shown in FIG. 7, damper 140 may be positioned between adjacent turbine blades 30 to help regulate the flow of high-pressure gases. It is contemplated that damper 140 may extend from circumferential outer edge 142 of turbine rotor 24 in a damper chamber 144 (best shown in FIG. 2). That is, damper chamber 144 may define a space between adjacent turbine blades 30 that is substantially below turbine platforms 34 of the adjacent turbine blades 30. Damper 140 may include a forward wall 146 positioned adjacent forward end 56 of root structure 36 and an aft wall 148 positioned adjacent aft end 58 of root structure 36. Damper 140 may not seal a forward end of damper chamber 144 proximate a forward wall 146 of damper 140, but may seal an aft end of damper chamber 144 proximate an aft wall 148 of damper 140. Further, damper 140 may include a central wall 150 longitudinally extending between forward wall 146 and aft wall 148.

INDUSTRIAL APPLICABILITY

The disclosed turbine blade may be applicable to any rotary power system, for example, a GTE. The disclosed turbine blade may regulate the flow of high-pressure gases with a moveable element housed within a cavity formed between adjacent turbine blade platforms. The process of assembling turbine blades 30 to turbine rotor 24 and operation of turbine blade 30 will now be described.

Prior to assembling turbine blades 30 on turbine rotor 24, the aft rim seal (not shown) may be fastened to the aft face of turbine rotor 24 to limit aft movement of turbine blades 30, for example, during assembly and during operation of GTE 10. Then, first turbine blade 116 may be slidably mounted into first slot 38 of turbine rotor 24. Further, damper 140 may be positioned on circumferential outer edge 142 of turbine rotor 24 adjacent first turbine blade 116. Aft wall 148 of damper 140 may be positioned aft of first turbine blade 116.

Either prior to or following slidably mounting first turbine blade 116 within first slot 38, pin seal 86 may be positioned within pressure side pocket 74 of first turbine blade 116. When GTE 10 is not in operation (i.e., turbine rotor 24 is not rotating), pin seal 86 may be sufficiently recessed within pressure side pocket 74 under the force of gravity to provide clearance for permitting second turbine blade 118 to slide into second slot 39 past pin seal 86.

Once first turbine blade 116 is mounted on turbine rotor 24 and pin seal 86 is positioned within pressure side pocket 74, second turbine blade 118 may be slidably mounted adjacent first turbine blade 116 within second slot 39 of turbine rotor 24. Moreover, second turbine blade 118 may be slidably mounted in a direction substantially parallel to the rotational axis (i.e., longitudinal axis 28) of the turbine rotor 24, adjacent first turbine blade 116 on turbine rotor 24 without interference by pin seal 86 housed substantially entirely within pressure side pocket 74 of first turbine blade 116 or entirely within pressure side pocket 74 of first turbine blade 116. That is, second turbine blade 118 may slide into second slot 39 substantially in a direction parallel to longitudinal axis 28, but may be angled in alignment with the broach angle of second slot 39. It is also contemplated that damper 140 may be positioned on circumferential outer edge 142 of turbine rotor 24 adjacent first turbine blade 116 prior to mounting second turbine blade 118 on turbine rotor 24. Assembly of additional turbine blades 30, pin seals 86, and dampers 140 may be performed around the circumference of turbine rotor 24.

After all of turbine blades 30 are slidably mounted on turbine rotor 24, the forward rim seal (not shown) may be fastened to the forward face of turbine rotor 24 to limit forward movement of turbine blades 30. It is contemplated that a pin seal 86 may be used between adjacent turbine blades 30 of any of the turbine stages of GTE 10. In an exemplary embodiment, a pin seal 86 may be implemented between adjacent turbine blades 30 in each of the turbine stages. Alternatively, a pin seal 86 may be implemented between adjacent turbine blades 30 in only the first stage of GTE 10.

After turbine rotor 24 is assembled and during operation of GTE 10, pin seal 86 may move under centrifugal force in the direction indicated by arrow 138, from the first position (e.g., dashed lines in FIG. 6) guided by concave surface 128, convex surface 130, and planar surface 132 within pressure side pocket 74 to the second position (e.g., solid lines in FIG. 6) wedged between planar surface 132 and interior surface 124 of suction side pocket 98. In the first position, pin seal 86 may be disposed substantially entirely within pressure side pocket 74 and entirely outside of suction side pocket 98. In the second position, pin seal 86 may span gap 122, partially within pressure side pocket 74 and partially within suction side pocket 98.

During travel from the first position to the second position, at least a majority length (i.e., in an axial direction) of pin seal 86 may engage convex surface 130 and planar surface 132. That is, since convex surface 130 and planar surface 132 may continuously extend between forward wall 78 and aft wall 80 of pressure side pocket 74, a majority length of pin seal 86 may engage convex surface 130 and planar surface 132 when pin seal 86 moves from the first position to the second position. In contrast, pin seal 86 may only engage concave surface 128 adjacent forward wall 78 and aft wall 80 of pressure side pocket. Since concave surface 128 may be discontinuous between forward wall 78 and aft wall 80 of pressure side pocket 74, less than a majority length of pin seal 86 may engage concave surface 128. Hence, a central portion of the outer circumference of pin seal 86, located substantially midway between the ends of pin seal 86, may engage convex surface 130 and planar surface 132 during movement from the first position to the second position, but the central portion of pin seal 86 may not engage concave surface 128. In the second position (i.e., pin seal engaging planar surface 132 of pressure side pocket 74 and interior surface 124 of suction side pocket 98), pin seal 86 may regulate the amount of high-pressure gases permitted to ingress into damper chamber 144 through gap 122. Regulation of the flow of high-pressure gases into damper chamber 144 through gap 122 via pin seal 86 may decrease fatigue and failure of turbine blade 30 due to excessive heat and/or vibration.

The flow of high-pressure gases past turbine blade 30 may be further regulated by damper 140. For example, damper 140 may permit the flow of high-pressure gases to seep around forward wall 146 into damper chamber 144 and may limit the flow of high-pressure gases escaping damper chamber 144 with a seal formed by aft wall 148 to generate a positive pressure within damper chamber 144. The positive pressure generated by damper 140 in damper chamber 144 may help pin seal 86 buffer the ingress of high-pressure gases into damper chamber 144 through gap 122. That is, the gases within damper chamber 144 may be at a higher-pressure than the gases flowing over upper surface 44 of turbine platform 34 (i.e., outside damper chamber 144), wherein the lower-pressure gases flowing over turbine platform 34 may be less likely to ingress into the higher-pressure zone of damper chamber 144 through gap 122.

Since turbine blade 30 may include a first side pocket (e.g., pressure side pocket 74) that is sufficiently deep to house pin seal 86 to provide clearance for mounting an adjacent turbine blade 30 on turbine rotor 24, the complexity of assembling turbine blades 30 on turbine rotor 24 may be decreased. Further, implementing the first side pocket (e.g., pressure side pocket 74) with a complex geometry including concave, convex, and planar surfaces 128, 130, 132 within turbine platform 34 may permit receiving and guiding pin seal 86 without unduly weakening the structural integrity of turbine platform 34 or increasing the thickness of turbine platform 34.

It will be apparent to those skilled in the art that various modifications and variations can be made to the disclosed turbine blade without departing from the scope of the disclosure. Other embodiments of the turbine blade will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A turbine blade, comprising:

an airfoil extending from a first surface of a turbine platform;

a first side pocket of the turbine platform configured to substantially entirely house a first moveable seal between a forward wall of the first side pocket and an aft wall of the first side pocket, wherein the first side pocket includes a convex surface, extending between the forward wall and the aft wall, and a concave surface; and a second side pocket of the turbine platform configured to receive a portion of a second moveable seal.

2. The turbine blade of claim 1, wherein the convex surface is positioned between the concave surface and a planar surface, and the convex surface provides a transition from the concave surface to the planar surface.

3. The turbine blade of claim 2, wherein the second side pocket includes a concave surface extending between a forward wall and an aft wall of the second side pocket.

4. The turbine blade of claim 1, further including a root structure extending from a second surface of the turbine platform.

5. The turbine blade of claim 1, wherein the concave surface of the first side pocket includes a lower surface that is discontinuous and includes a forward shelf separated from an aft shelf by a gap.

6. The turbine blade of claim 5, wherein the turbine platform further includes a first side cavity at least partially extending below the gap in the lower surface of the first side pocket.

7. The turbine blade of claim 6, wherein the first side cavity extends deeper within the turbine platform relative to a first side of the platform than the first side pocket.

8. The turbine blade of claim 7, wherein the first side cavity includes a first support for supporting a first overhanging portion of the turbine platform.

9. The turbine blade of claim 8, further including a second side cavity on the second side of the turbine platform, the second side cavity including a second support for supporting a second overhanging portion of the turbine platform.

10. The turbine blade of claim 1, wherein the first side pocket is configured to house the first moveable seal entirely within the first side pocket.

11. The turbine blade of claim 1, wherein the first side pocket is a pressure side pocket and the second side pocket is a suction side pocket.

12. A method of assembling a turbine rotor assembly, the method comprising:

mounting a first turbine blade to a turbine rotor;

positioning a moveable seal substantially entirely within a side pocket of the first turbine blade; and after mounting the first turbine blade to the turbine rotor and after positioning the moveable seal substantially entirely within the side pocket, slidably mounting a second turbine blade to the turbine rotor in a direction substantially parallel to the rotational axis of the turbine rotor past the moveable seal.

13. The method of claim 12, wherein mounting the first turbine blade to the turbine rotor includes slidably mounting the first turbine blade to the turbine rotor.

14. The method of claim 12, further including the step of positioning a damper adjacent the first turbine blade.

15. The method of claim 12, wherein positioning the moveable seal substantially entirely within the side pocket of the first turbine blade includes positioning the moveable seal substantially entirely within a pressure side pocket of the first turbine blade.

16. A turbine rotor assembly, comprising:

a turbine rotor including a first slot and a second slot;

a first turbine blade mounted within the first slot and including a pressure side pocket on a pressure side of the first turbine blade, the pressure side pocket including a concave surface and convex surface;

a second turbine blade mounted within the second slot and including a suction side pocket mounted on a suction side of the second turbine blade; and a moveable seal configured to move between a first position where the moveable seal is disposed entirely outside of the suction side pocket and a second position where the moveable seal is disposed partially within the suction side pocket.

17. The turbine rotor assembly of claim 16, wherein the pressure side pocket and the suction side pocket have a different cross-sectional geometry.

18. The turbine rotor assembly of claim 16, wherein the moveable seal is a pin seal, and the pin seal includes a diameter that is less than the distance between the deepest portion of the pressure side pocket and a plane extending along a suction side slash face of the second turbine blade.

19. The assembly of claim 16, further including a damper mounted on a circumferential outer edge of the turbine rotor between the first turbine blade and the second turbine blade.

20. A method of regulating the flow of gases past a turbine rotor, comprising:

rotating the turbine rotor;

guiding a moveable seal from a first position, housed substantially entirely within a first turbine blade, along a concave surface of the first turbine blade and a convex surface of the first turbine blade into a second position, wherein the moveable seal is wedged between the first turbine blade and a second turbine blade.

21. The method of claim 20, wherein guiding the moveable seal includes guiding a pin seal along the convex surface such that a majority length of the pin seal engages the convex surface as the pin seal moves from the first position to the second position.

22. The method of claim 21, wherein guiding the pin seal includes guiding the pin seal along a planar surface after the pin seal passes the convex surface.

23. The method of claim 20, further including permitting a portion of the flow of gases to pass into a damper chamber between the first turbine blade and the second turbine blade to produce a higher-pressure zone within the damper chamber than outside the damper chamber.

* * * * *